US012150506B1

(12) United States Patent
Hadfield

(10) Patent No.: US 12,150,506 B1
(45) Date of Patent: Nov. 26, 2024

(54) BODILY FLUID POUCH CONCEALMENT SYSTEM

(71) Applicant: John D. Hadfield, Newark, DE (US)

(72) Inventor: John D. Hadfield, Newark, DE (US)

( * ) Notice: Subject to any disclaimer, the term of this patent is extended or adjusted under 35 U.S.C. 154(b) by 0 days.

(21) Appl. No.: 18/380,260

(22) Filed: Oct. 16, 2023

Related U.S. Application Data

(63) Continuation of application No. 17/988,270, filed on Nov. 16, 2022, now Pat. No. 11,785,997.

(60) Provisional application No. 63/280,124, filed on Nov. 16, 2021.

(51) Int. Cl.

| | |
|---|---|
| ***A41D 27/00*** | (2006.01) |
| ***A41D 13/00*** | (2006.01) |
| ***A41D 27/20*** | (2006.01) |
| *A45F 5/02* | (2006.01) |

(52) U.S. Cl.
CPC ..... *A41D 27/20* (2013.01); *A41D 13/0012* (2013.01); *A45F 5/02* (2013.01)

(58) Field of Classification Search
CPC ..... A41D 27/20; A41D 13/0012; A45F 5/02
See application file for complete search history.

(56) References Cited

U.S. PATENT DOCUMENTS 2,663,876 A * 12/1953 Miller ..... A41D 1/06 D2/742
4,511,358 A * 4/1985 Johnson, Jr. ..... A61F 5/4404 604/327
4,513,455 A * 4/1985 Gerhardt ..... C07C 51/353 D2/857
4,533,355 A * 8/1985 Fair ..... A61F 5/445 2/403
4,820,291 A 4/1989 Terauchi et al.
5,032,118 A * 7/1991 Mason ..... A61F 5/4408 604/353
5,135,520 A * 8/1992 Beaupied ..... A61F 5/449 604/345
5,643,233 A * 7/1997 Turner ..... A61F 5/4408 224/663
5,935,116 A 8/1999 Kristensen
6,110,156 A * 8/2000 Mendonca ..... A61F 5/445 604/345

(Continued)

FOREIGN PATENT DOCUMENTS

CN 106723524 B 12/2018
CN 209152428 U 7/2019

*Primary Examiner* — Richale L Quinn
(74) *Attorney, Agent, or Firm* — Invention To Patent Services; Alex Hobson

(57) ABSTRACT

A bodily fluid pouch concealment system employs a bodily fluid pouch pocket in trousers that has an exterior and interior access to enable a collection tube to extend along the interior of the trousers to provide discrete concealment of the bodily fluid pouch retained within said pocket and the collection tube. The bodily fluid pouch pocket, may be a cargo pocket that is specifically configured to conceal the bodily fluid pouch within. The pocket may have one or more pleats that produces an exterior wall that is greater in width than a width between the first side attachment to the second side attachment of the exterior wall to cause the cargo pocket exterior wall to protrude from said exterior of said trouser exterior. This protruding type pocket with a built-in expansion capability in the exterior wall may provide effective concealment of the bodily fluid pouch.

19 Claims, 5 Drawing Sheets

(56) References Cited

U.S. PATENT DOCUMENTS 6,477,710 B1 11/2002 Ojoyeyi
6,760,922 B1 * 7/2004 Morales ..... A41D 13/0012 2/102
7,000,261 B1 * 2/2006 Loffredo ..... A61F 5/449 2/400
7,032,249 B2 4/2006 Smith
7,418,741 B2 * 9/2008 Rogers ..... A41D 13/1236 2/114
8,486,035 B1 * 7/2013 Arce ..... A61F 5/449 2/72
8,690,835 B1 * 4/2014 Parris ..... A41D 13/1236 604/179
10,051,900 B2 8/2018 Carryl et al.
10,306,939 B2 * 6/2019 Huang ..... A41D 1/06
11,382,371 B2 * 7/2022 Bentley ..... A41D 13/1281
2003/0205595 A1 * 11/2003 Young ..... F41C 33/0218 224/230
2004/0226073 A1 * 11/2004 McCullar ..... A41D 13/1245 2/114
2007/0157362 A1 * 7/2007 Rogers ..... A41D 13/1263 2/114
2010/0017943 A1 * 1/2010 Morales ..... A41D 13/0012 2/227
2011/0072556 A1 * 3/2011 Bang ..... A41D 27/08 2/247
2013/0067633 A1 * 3/2013 Salem ..... A41D 13/1245 2/102
2015/0089708 A1 * 4/2015 Trevino ..... A41D 13/0012 2/69
2015/0196066 A1 * 7/2015 Emanuel ..... A41D 31/30 424/630
2016/0050995 A1 * 2/2016 Bentley ..... A41D 27/207 2/114
2016/0206022 A1 * 7/2016 Kroecher ..... A41D 15/002
2017/0311662 A1 11/2017 Deysi et al.
2020/0359722 A1 * 11/2020 Cleghorn ..... A41D 1/06

* cited by examiner

BODILY FLUID POUCH CONCEALMENT SYSTEM

CROSS REFERENCE TO RELATED APPLICATIONS

This application is a continuation of U.S. patent application Ser. No. 17/988,270 filed on Nov. 16, 2022, which claims the benefit of priority to U.S. provisional patent application No. 63/280,124 filed on Nov. 16, 2021; the entirety of which is hereby incorporated by reference herein.

BACKGROUND OF THE INVENTION

Field of the Invention

The invention relates to a bodily fluid pouch concealment system that employs a bodily fluid pouch pocket in trousers that has an exterior and interior access to enable a collection tube to extend along the interior of the trousers to provide discrete concealment of the bodily fluid pouch retained within said pocket.

Background

There are any number of procedures that require a bodily fluid pouch coupled with a collection tube that extends to a port to collect bodily fluid. Many people are discharged from the hospital but are required to continue to collect bodily fluids from this port. The bodily fluid pouch may be rather large and placing it in the pocket with the collection tube extending up and out of a pocket is very noticeable. A person may want to be discrete about the collection of bodily fluids and may not want this to be the topic of conversation. Street clothing does not provide a means to conceal the bodily fluid pouch and the collection tube extending therefrom.

SUMMARY OF THE INVENTION

The invention is directed to a bodily fluid pouch concealment system that employs a bodily fluid pouch pocket in trousers that has an exterior and interior access to enable a collection tube to extend along the interior of the trousers to provide discrete concealment of the bodily fluid pouch retained within said pocket and the collection tube. The bodily fluid pouch pocket, or pocket as used herein, may be a cargo pocket that is specifically configured to conceal the bodily fluid pouch within. The pocket may have one or more pleats that produces an exterior wall that is greater in width than a width between the first side attachment to the second side attachment of the exterior wall to cause the cargo pocket exterior wall to protrude from said exterior of said trouser exterior. This protruding type pocket with a built in expansion capability in the exterior wall may provide effective concealment of the bodily fluid pouch.

A trouser as used herein is a pair of pants or shorts that has a waist band and left and right leg extensions. A trouser may have the bodily fluid pouch pocket on one or both of the left and right leg extensions and this pocket may be configured along the front, side and/or back of the trouser.

A trouser has an exterior having an exterior trouser fabric and an interior with an interior trouser fabric. The interior fabric and exterior fabrics may be a single fabric, a laminate or combination of attached fabric or separate fabrics. In an exemplary embodiment, the cargo pocket has a cargo pocket exterior wall that is attached to the exterior trouser fabric over a trouser pocket aperture in the trouser and is attached on a first side and a second side by a first side attachment and second side attachment, such as stitching. The width of the cargo pocket exterior wall between the first side attachment and the second side attachment may be substantially greater than the width from the first side attachment to the second side attachment, to enable expansion of the trouser exterior pocket wall; wherein the width of trouser exterior pocket wall is about 10% greater or more, and preferably about 20% or more, or 30% or more, or at least 10% greater or at least 20% greater. A cargo pocket exterior wall may have a pleat that enables the cargo pocket to expand as required to accommodate the bodily fluid pouch as it expands due to the collection of bodily fluid. This pleat and expansion capability may effectively conceal the bodily fluid pouch.

Furthermore, the cargo pocket may have a trouser interior pocket wall that is attached to the interior trouser fabric over the same trouser pocket aperture in the trouser. Again, the trouser interior pocket wall may be attached on a first side and a second side by a first side attachment and second side attachment, such as stitching. The width of the trouser interior pocket wall between the first side attachment and the second side attachment may be substantially greater than the width from the first side attachment to the second side attachment to enable expansion of the trouser interior pocket wall; wherein the width of trouser interior pocket wall is about 10% greater or more, and preferably about 20% or more, or 30% or more, or at least 10% greater or at least 20% greater. The trouser interior pocket wall may also have a pleat that enables the trouser interior pocket to expand as required to accommodate the bodily fluid pouch as it expands due to the collection of bodily fluid. This combination of an expanding interior and exterior pocket wall configured over a trouser pocket aperture produces a cargo pocket that can effectively conceal a bodily fluid pouch.

The cargo pocket has an exterior top access or opening as well as an interior top access or opening. The collection tube may be coupled with the bodily fluid pouch within the pocket and may extend up and out through the interior top access, under the waistband of the trouser and to a collection port coupled to the person's body to collect bodily fluid. In this way, the entirety of the bodily fluid pouch and collection tube can be concealed from the exterior of the trouser.

A trouser may have a top flap that extends down over the exterior top access or opening to further conceal the bodily fluid pouch configured within the pocket. A person may access or check on the bodily fluid pouch from the exterior top access, wherein they may open the top flap and view the bodily fluid pouch within the pocket.

A trouser may include multiple layers of trouser fabric and an interior of the trouser fabric may be a different material or layer of the trouser fabric than the exterior of the trouser fabric. However, a trouser fabric in most cases will be a single layer of woven fabric.

The trouser interior pocket wall and/or the trouser exterior pocket wall may have one or more pleats. A cargo pocket usually has two pleats to form an off-standing pocket wall portion of the pocket wall that is offset an offset distance from the pocket wall by the pleats. This off-standing pocket wall portion may further aid in concealment of the bodily fluid pouch within the pocket. The offset distance may be the double the thickness of the pocket wall fabric as the pleat creates a fold in the fabric and it may be greater than this as they pleat may not be pressed. The off-standing pocket wall portion may be a substantial portion of the width of the pocket wall, such as at least 20% or more, about 30% or more, about 40% or more or even 50% or more and any range between and including the width percentages provided.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
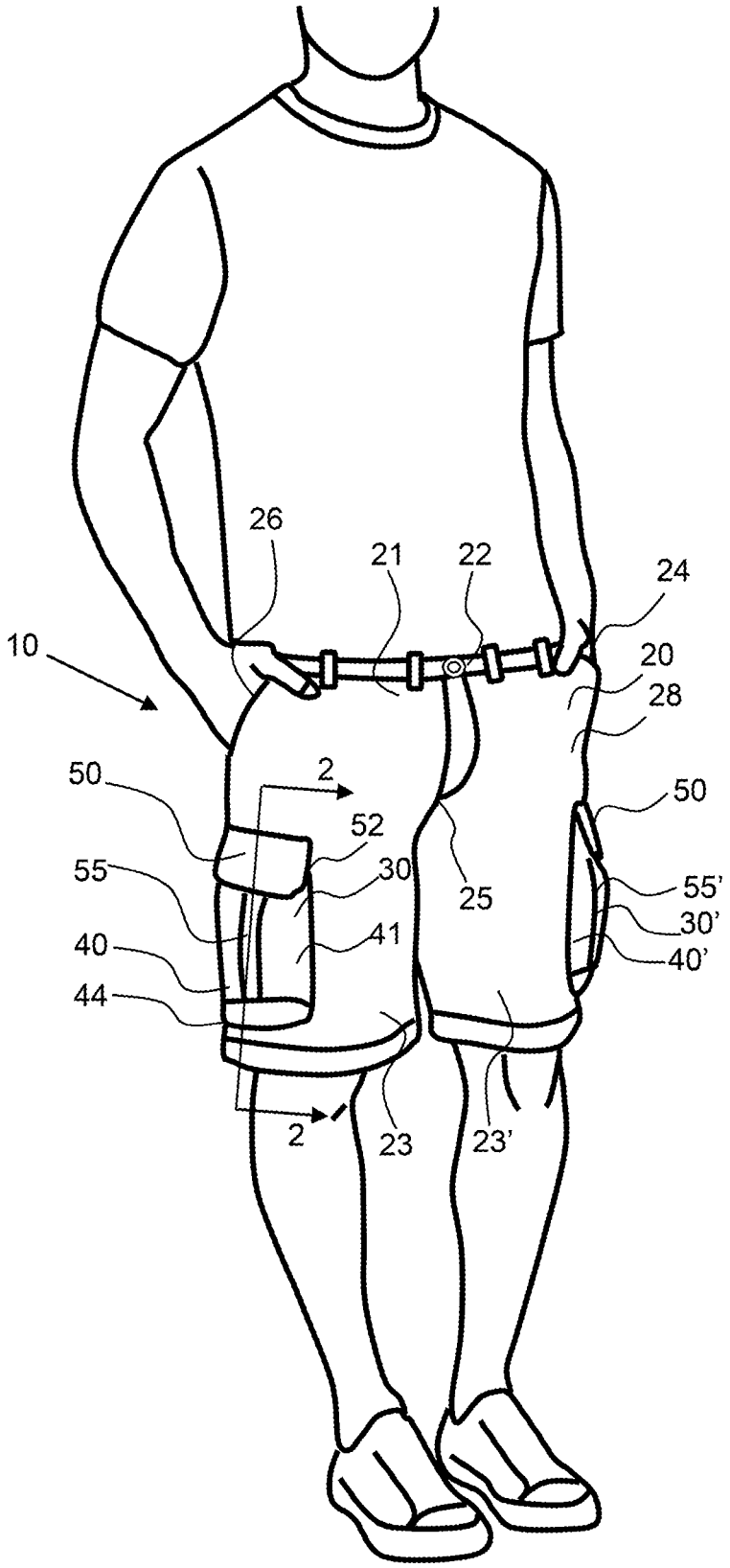
FIG. 1 shows a front perspective view of a person wearing a pair of trousers comprising a bodily fluid pouch concealment system including a cargo pocket that expands in a width direction to accommodate a bodily fluid pouch.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to understood that where possible, features and components from one figure may be an included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Referring now to the Figures, a bodily fluid pouch concealment system 10 includes a bodily fluid pouch pocket 30 formed in a pair of trousers 20, with a cargo pocket exterior wall 41 forming the exterior of the pocket with a pleat 55 to enable expansion in width and to better conceal the bodily fluid pouch configured within the bodily fluid pouch pocket 30. The interior of the bodily fluid pouch pocket 30 is formed by a trouser interior pocket wall 81, which may extend over the trouser pouch aperture 35. The trouser interior pocket wall 81 may also have a pleat 95 to enable expansion of this interior wall of the bodily fluid pouch pocket to accommodate the increasing size of the bodily fluid pouch as bodily fluid drains therein.

As shown in FIG. 1, the trousers 20 are cargo trouser 21, such as shorts as shown, having a pair of cargo pockets 40, 40' on the right and left sides of the trousers, respectively. The trousers have a trouser fabric 28 and a waist band 22, that may be an elastic waistband to better enable the fluid collection tube to extend there under and for access to the bodily fluid pouch from the inside of the trouser. The trousers may be long trousers or pants versus shorts as shown and the cargo trouser may have a left pocket 24 and right pocket 26, as shown. The cargo pocket or bodily fluid pouch pocket 30, 30' may be configured down along the leg extension 23 of the trouser and may be configured below a crotch coupling 25 of the left and leg extension or right leg extension 23'. Configuring the bodily fluid pouch pocket along the leg extension and particular down along the leg extension below the crotch coupling 25 provides better movement of the individual with the bodily fluid pouch configured away from the front or interior of their legs.

With continued reference to FIG. 1, the cargo pocket exterior wall 41 extends across the exterior of the bodily fluid pouch pocket 30 and includes a pleat 55 to enable the cargo pocket exterior wall 41 to expand and conceal the bodily fluid pouch retained therein. A top flap 50 extends down over the exterior top access to the bodily fluid pouch pocket 30 or top of the cargo pocket exterior wall 41 to further enable concealment of the bodily fluid pouch contained therein. Note that a bodily fluid pouch pocket may be configured on one or both sides of the trousers. As shown, a bodily fluid pouch pocket is configured on both the right leg extension and left leg extension of the cargo shorts.

Figure 2:
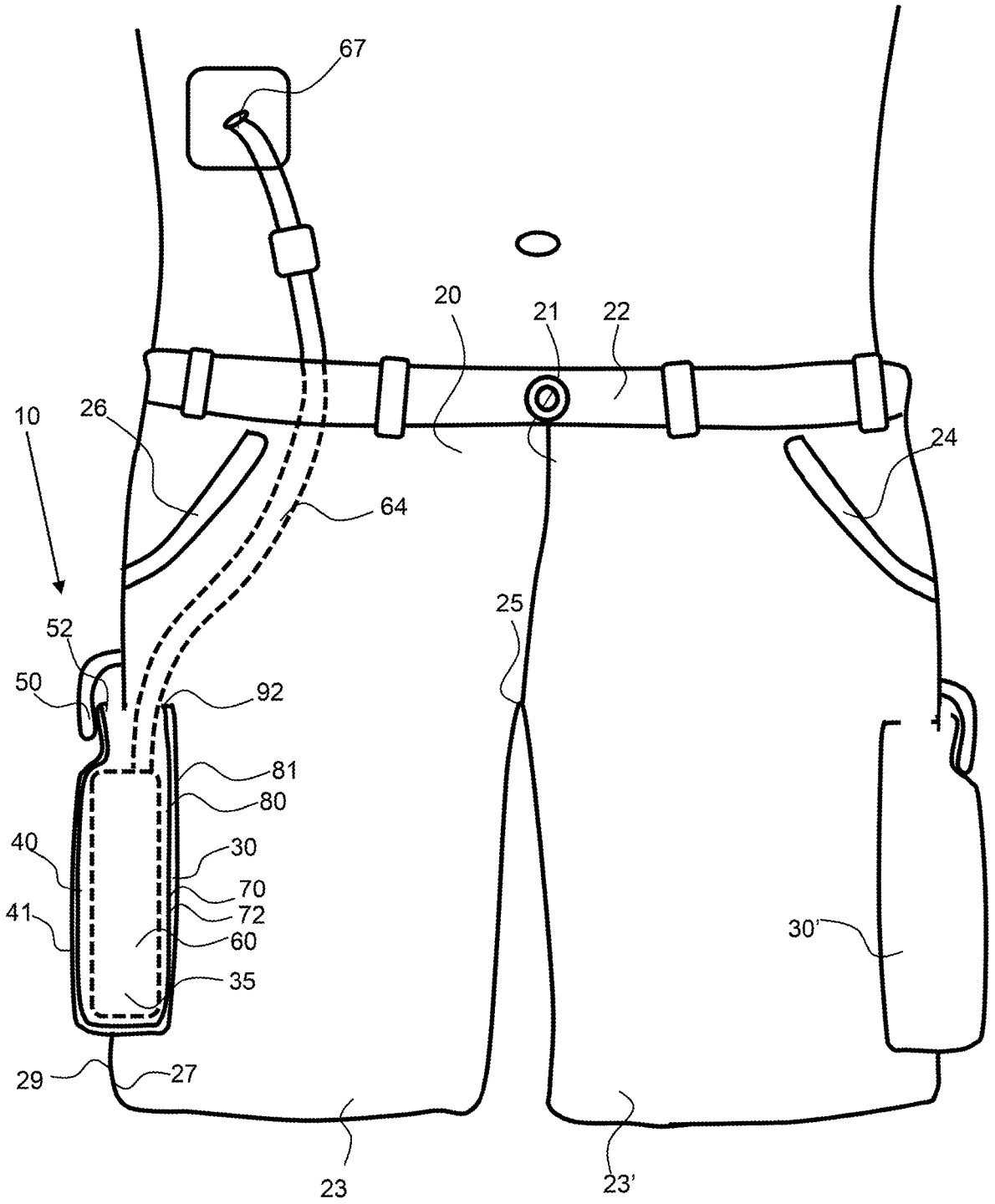
FIG. 2 shows a front view of a bodily fluid pouch concealment system having a bodily fluid pouch pocket for receiving a bodily fluid pouch therein with a collection tube extending out through the interior top access and inside of the trousers to a collection port; wherein the bodily fluid pouch pocket extends from the cargo pocket exterior wall to the trouser interior pocket wall through a fluid pouch pocket aperture in the trouser fabric.

Referring now to FIG. 2, a bodily fluid pouch concealment system 10 includes a bodily fluid pouch pocket 30 formed in a pair of trousers 20 that is configured for receiving a bodily fluid pouch 60 with a collection tube 64 extending through the interior of the trousers and under the waist band 22, to a collection port 67 for collecting bodily fluid. The bodily fluid will drain down into the bodily fluid pouch under gravity and having the bodily fluid pouch pocket 30 formed down along the leg extension 23, enables gravity feed, even when a person is sitting and better maintains the bodily fluid pouch in an upright configuration. The bodily fluid pouch pocket 30 is formed between the cargo pocket exterior wall 41, extending on an exterior of the trouser 20 and a trouser interior pocket wall 81. The cargo pocket is wider than a width between a back and front attachment to the trouser and may have a pleat 55 to enable expansion of the cargo pocket exterior wall to accommodate the bodily fluid pouch as it expands. Likewise, the trouser interior pocket wall may be wider than a back and front attachment to the trouser to enable containment of the bodily fluid pouch. The trousers may have a trouser pocket aperture 35 to produce a greater volume pocket. The trouser interior pocket wall may be an extension of the trouser fabric, or may be a separate piece of material, such as a fabric or pouch that extends on an interior side of the trouser pocket aperture 35. When the trouser interior pocket wall is a separate piece of material, it may be wider than the trouser pocket aperture and/or a back and forward attachment of the trouser interior pocket wall to enable interior expansion of the pocket to accommodate the bodily fluid pouch.

As shown in FIG. 2, the bodily fluid pouch pocket 30 has an interior top access 92 to enable the collection tube 64 to extend into the pocket where it is couple with the bodily fluid pouch 60. The bodily fluid pouch pocket 30 also has an exterior top access 52 for access from an exterior of the trouser 20. As shown, a top flap 50 extends down over the exterior top access to conceal contents within the bodily fluid pouch pocket 30. As shown, the bodily fluid pouch pocket 30 extend outward from the exterior 29 of the trouser fabric and inward from the interior 27 of the trouser fabric, thereby providing amble room for receiving the bodily fluid pouch 60. Again, a bodily fluid pouch pocket 30 may be configured on the right leg extension 23 and second bodily fluid pouch pocket 30' may be configured on a left leg extension 23' and each may be configured below a crotch coupling 25 of the trouser, or more distal from the waistband 22 than the crotch coupling.

Also shown in FIG. 2 is a waterproof liner 70 that may be configured within the interior of the bodily fluid pouch pocket 30 and line the bodily fluid pouch pocket 30 as well as the trouser interior pocket wall 81 to create a waterproof receptacle 72 for the bodily fluid pouch 60.

Figure 3:
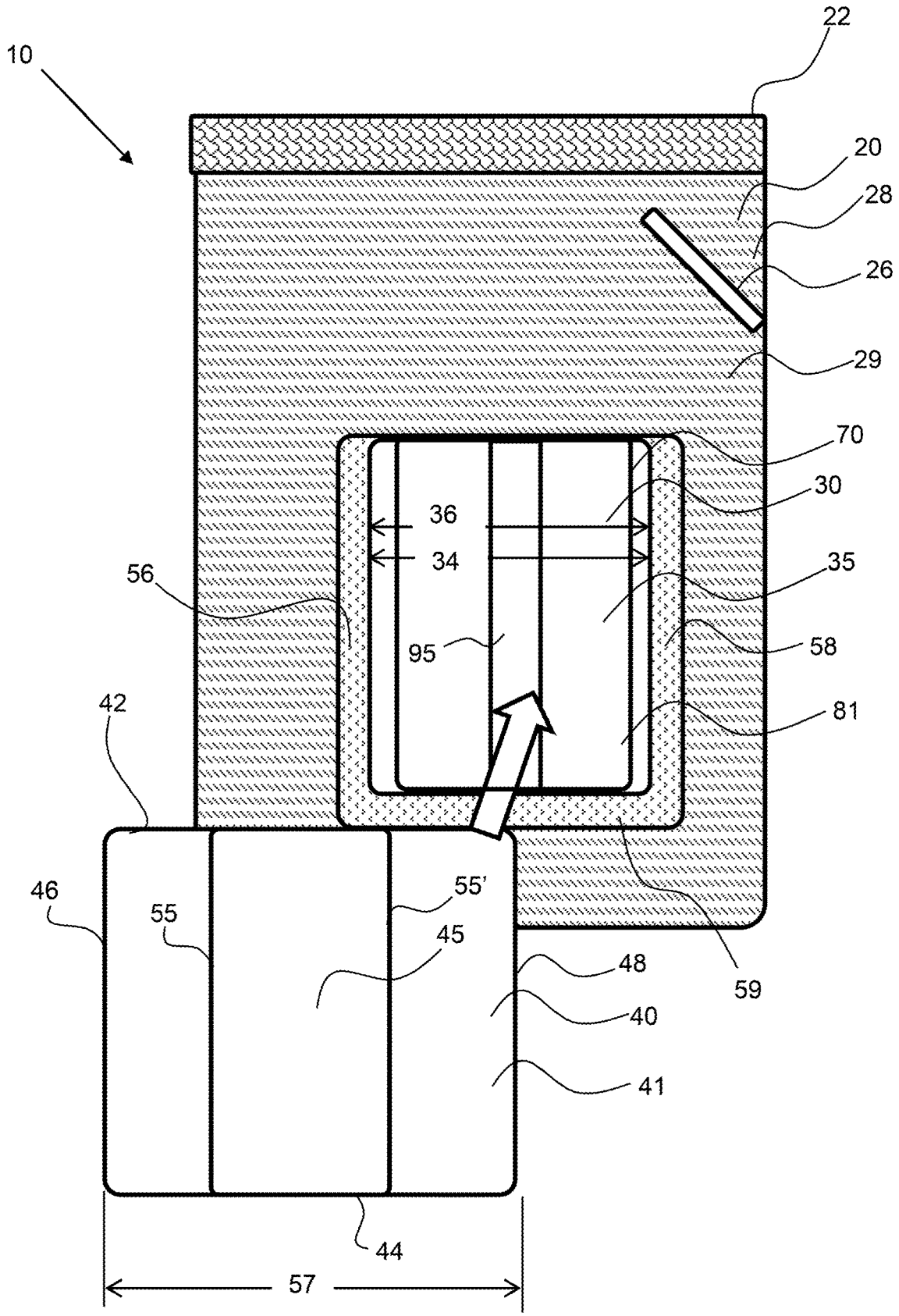
FIG. 3 shows an exterior of the trouser having the fluid pouch pocket aperture in the trouser fabric with the cargo pocket exterior wall detached from the back side and front side attachments and having a width that is greater than the width between the back side and front side attachments to provide expansion for receiving the bodily fluid pouch therein.

As shown in FIG. 3, the cargo pocket exterior wall 41 of the cargo pocket 40 is detached from the trouser 20. The cargo pocket exterior wall 41 has a width 57, when pulled out to extend the pocket exterior wall straight and extend the pleat, that is greater than an exterior attachment width 34, or a width between a back side or first side attachment 56 and front side or second side attachment 58 of the cargo pocket exterior wall 41. The cargo pocket exterior wall extends a width 57 from the back side or first side 46 to the front or second side 48, which may also be greater than the trouser pocket aperture width 36. The cargo pocket exterior wall 41 may include one or more pleats 55, 55' that are expandable to increase the width of the cargo pocket exterior wall as the bodily fluid pouch expands. The cargo pocket exterior wall 41 has a height from a top 42 to a bottom 44. The two pleats form an off-standing pocket wall portion 45, indicative of a cargo pocket. The back attachment, front attachment and bottom attachment 59 may be detachably attachable attachments, such as hook-and-loop fastener, or may be a fixed attachment, such as a stitched seam to secure the cargo pocket exterior wall to the trouser 20, such as to the exterior 29 of the trouser or trouser fabric.

Figure 4:
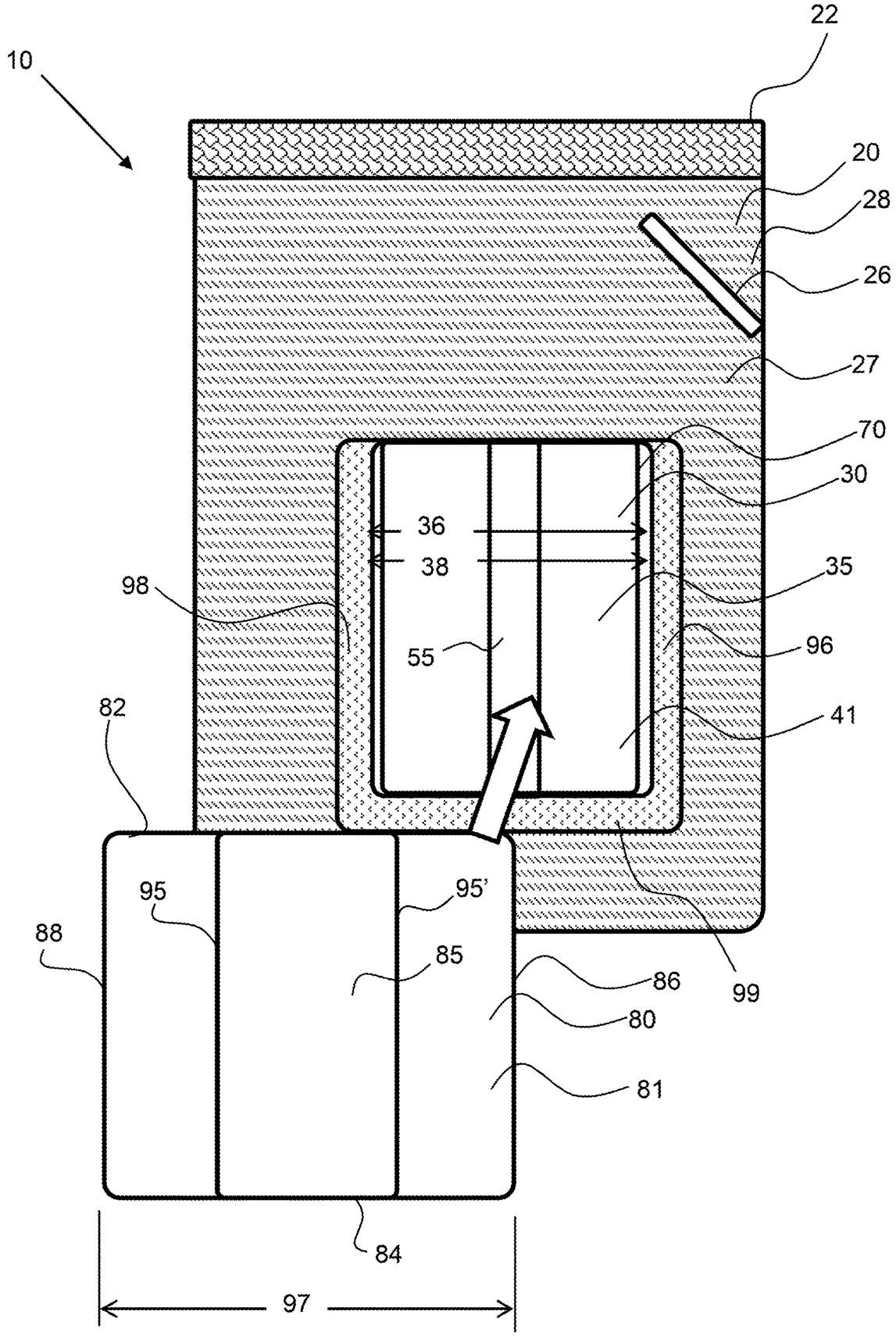
FIG. 4 shows an interior of the trouser having the fluid pouch pocket aperture in the trouser fabric with the trouser pocket interior wall detached from the back side and front side attachments and having a width that is greater than the width between the back side and front side attachments to provide expansion for receiving the bodily fluid pouch therein.

As shown in FIG. 4, the trouser interior pocket wall 81 of the trouser interior pocket 80 is detached from the trouser 20. The trouser interior pocket wall 81 has a width 97 that is greater than an interior attachment width 38, or a width between a back attachment 96 and front attachment 98 of the trouser interior pocket wall. The trouser interior pocket wall width 97, from the front side 88 to the back side 86, and may also be greater than the trouser pocket aperture with 36. The trouser interior pocket wall may include one or more pleats 95, 95' that are expandable to increase the width of the cargo pocket exterior wall as the bodily fluid pouch expands. The cargo pocket interior pocket wall 81 has a height from a top 82 to a bottom 84 The two pleats form an off-standing pocket wall portion 85, indicative of a cargo pocket. The back attachment, front attachment and bottom attachment 99 may be detachably attachable attachments, such as hook-and-loop fastener, or may be a fixed attachment, such as a stitched seam to secure the trouser interior pocket wall to the trouser 20, such as to the interior 27 of the trouser fabric.

Figure 5:
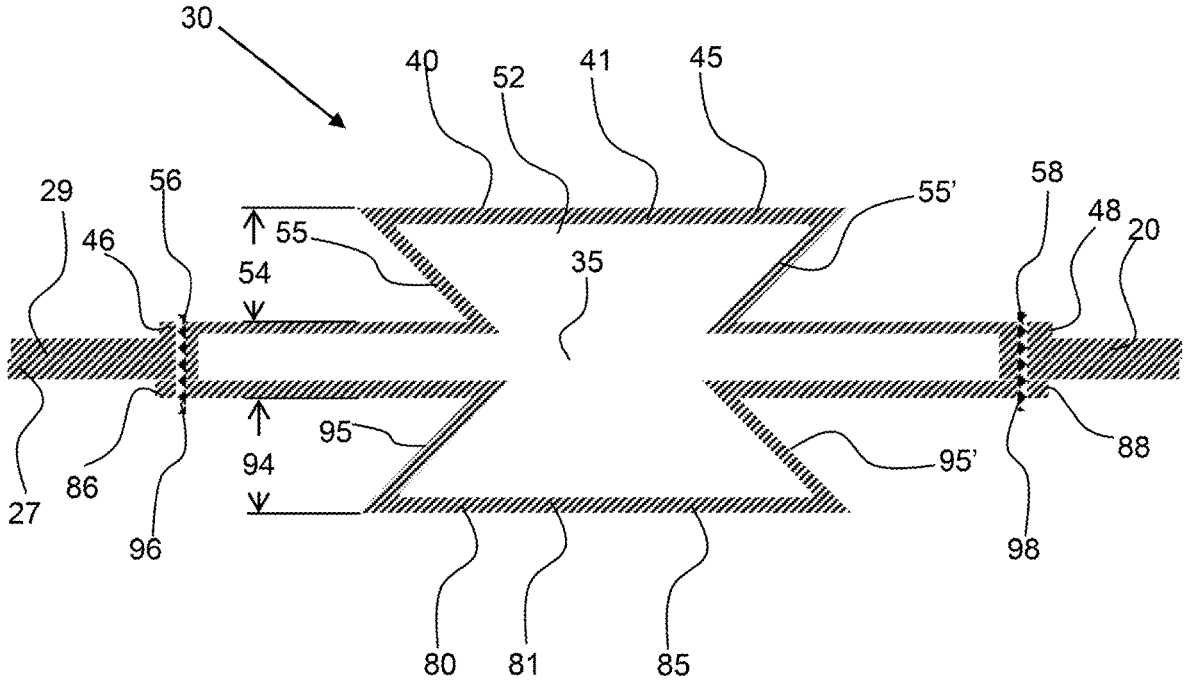
FIG. 5 shows a cross-sectional view of a bodily fluid pouch pocket that includes a cargo pocket on the outside of the trouser as well as an interior pocket wall that has a pair of pleats.

As shown in FIG. 5, the bodily fluid pouch pocket 30 is configured to expand to accommodate a bodily fluid pouch (not shown for clarity). A cargo pocket 40 is attached to the exterior 29 of the trouser fabric by a first side attachment 56 and a second side attachment 58. The cargo pocket exterior wall 41 has two pleats 55, 55' that form an off-standing pocket wall portion 45 that is an offset distance 54 from the exterior of the trouser fabric. The cargo pocket exterior wall is wider when pulled out to expand the pleats than the width from the first side attachment 56 and a second side attachment 58. The off-standing pocket wall portion 45 is a substantial portion of the width of the cargo pocket exterior wall 41 being at least 20% of the width. The bodily fluid pouch pocket 30 also has a trouser interior pocket 80 that is attached to the interior 27 of the trouser fabric by a first side attachment 96 and a second side attachment 98. The trouser interior pocket wall 81 has two pleats 95, 95' that form an off-standing pocket wall portion 85 that is an offset distance 94 from the interior 27 of the trouser fabric. The trouser interior pocket wall is wider when pulled out to expand the pleats than the width from the first side attachment 96 and a second side attachment 98. The off-standing pocket wall portion 85 is a substantial portion of the width of the cargo pocket trouser interior pocket wall 81 being at least 20% of the width.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A bodily fluid pouch concealment system comprising:

a) a trouser formed by a trouser fabric having a trouser exterior and a trouser interior;

b) a bodily fluid pouch pocket coupled to the trouser fabric and comprising:

i) a pocket exterior wall that extends from a first side attachment to a second side attachment configured on the trouser fabric; and ii) a trouser interior pocket wall;

wherein the pocket exterior wall protrudes from said exterior of said trouser exterior;

c) an exterior top access to said pocket;

d) an interior top access to said pocket extending along the top of the pocket that is an opening in the trouser interior pocket wall to said trouser interior;

e) a bodily fluid pouch being sized and configured within the pocket;

f) a collection tube extending from said bodily fluid pouch and configured to collect bodily fluid from a person donning said trouser; and wherein the bodily fluid pouch is configured for insertion into the pocket through the interior top access with the collection tube extending through the interior top access and along said trouser interior of the trouser fabric.

2. The bodily fluid pouch concealment system of claim 1, wherein the bodily fluid pouch pocket further comprises a flap extending down over the exterior top access of said pocket.

3. The bodily fluid pouch concealment system of claim 1, wherein the pocket exterior wall is greater in width than a width between the first side attachment to the second side attachment and wherein the pocket comprises a pleat extending along a length of said pocket exterior wall for expansion of said pocket exterior wall.

4. The bodily fluid pouch concealment system of claim 1, wherein the trouser fabric forms an interior wall of said pocket.

5. The bodily fluid pouch concealment system of claim 1, wherein the trouser fabric comprises a trouser pocket aperture and wherein the bodily fluid pouch pocket is configured around said trouser pocket aperture, wherein the pocket exterior wall extends over said trouser pocket aperture.

6. The bodily fluid pouch concealment system of claim 5, further comprising a trouser interior pocket wall that extends over said trouser pocket aperture.

7. The bodily fluid pouch concealment system of claim 6, wherein the trouser interior pocket wall extends from a first side attachment to a second side attachment configured on the trouser fabric; and wherein the trouser interior pocket wall is greater in width than a width between the first side attachment to the second side attachment to cause the trouser interior pocket wall to protrude into the interior of said trouser.

8. The bodily fluid pouch concealment system of claim 7, wherein the trouser interior pocket wall comprises a pleat extending along a length of said trouser interior pocket wall for expansion of said trouser interior pocket wall.

9. The bodily fluid pouch concealment system of claim 7, wherein the interior top access to said pocket extends along a top of said the trouser interior pocket wall.

10. The bodily fluid pouch concealment system of claim 1, wherein the first side attachment and second side attachment are detachably attachable along at least a portion of length of said first side attachment and second side attachment.

11. The bodily fluid pouch concealment system of claim 1, wherein the first side attachment and second side attachment are detachably attachable from a top of each of said first side attachment and said second side attachment.

12. The bodily fluid pouch concealment system of claim 1, further comprising a liquid proof liner configured within the pocket and configured to receive the bodily fluid pouch.

13. The bodily fluid pouch concealment system of claim 12, wherein the pocket exterior wall comprises two pleats that form an off-standing pocket wall portion that is offset an offset distance an exterior of the trouser fabric.

14. The bodily fluid pouch concealment system of claim 13, wherein the off-standing pocket wall portion of the pocket exterior wall is a substantial portion of a width of the pocket exterior wall being at least 20% of the width.

15. The bodily fluid pouch concealment system of claim 14, wherein the trouser interior pocket wall comprises two pleats that form an off-standing pocket wall portion that is offset an offset distance an interior of the trouser fabric.

16. The bodily fluid pouch concealment system of claim 15, wherein the off-standing pocket wall portion of the trouser interior pocket wall is a substantial portion of a width of the pocket exterior wall being at least 20% of the width.

17. The bodily fluid pouch concealment system of claim 13, wherein the off-standing pocket wall portion of the pocket exterior wall is a substantial portion of a width of the pocket exterior wall being at least 20% of the width.

18. The bodily fluid pouch concealment system of claim 17, wherein the trouser interior pocket wall comprises two pleats that form an off-standing pocket wall portion that is offset an offset distance an interior of the trouser fabric.

19. The bodily fluid pouch concealment system of claim 18, wherein the off-standing pocket wall portion of the trouser interior pocket wall is a substantial portion of a width of the pocket exterior wall being at least 20% of the width.

* * * * *